US011587521B2

(12) United States Patent
Xue

(10) Patent No.: US 11,587,521 B2
(45) Date of Patent: Feb. 21, 2023

(54) GATE DRIVER ON ARRAY (GOA) CIRCUIT AND DISPLAY DEVICE SOLVING PROBLEM OF ELECTRICAL STRESS EASILY BIASING THRESHOLD VOLTAGE OF THIN FILM TRANSISTOR (TFT)

(71) Applicant: Shenzhen China Star Optoelectronics Semiconductor Display Technology Co., Ltd., Guangdong (CN)

(72) Inventor: Yan Xue, Guangdong (CN)

(73) Assignee: Shenzhen China Star Optoelectronics Semiconductor Display Technology Co., Ltd., Guangdong (CN)

( * ) Notice: Subject to any disclaimer, the term of this patent is extended or adjusted under 35 U.S.C. 154(b) by 52 days.

(21) Appl. No.: 17/252,331

(22) PCT Filed: May 14, 2020

(86) PCT No.: PCT/CN2020/090122
§ 371 (c)(1),
(2) Date: Dec. 15, 2020

(87) PCT Pub. No.: WO2021/174675
PCT Pub. Date: Sep. 10, 2021

(65) Prior Publication Data

US 2022/0139348 A1 May 5, 2022

(30) Foreign Application Priority Data

Mar. 5, 2020 (CN) ..... 202010146510.5

(51) Int. Cl.
*G09G 3/36* (2006.01)

(52) U.S. Cl.
CPC ... *G09G 3/3677* (2013.01); *G09G 2300/0408* (2013.01); *G09G 2300/0842* (2013.01); *G09G 2320/0214* (2013.01)

(58) Field of Classification Search
CPC ..... G09G 3/36; G09G 3/3611; G09G 3/3648; G09G 3/3674; G09G 3/3677;
(Continued)

(56) References Cited

U.S. PATENT DOCUMENTS

2008/0048712 A1 2/2008 Ahn et al.
2013/0162508 A1* 6/2013 Li ..... G09G 3/3677 345/92

(Continued)

FOREIGN PATENT DOCUMENTS

CN 101064085 A 10/2007
CN 102708824 A 10/2012

(Continued)

*Primary Examiner* — Alexander Eisen
*Assistant Examiner* — Nelson Lam
(74) *Attorney, Agent, or Firm* — PV IP PC; Wei Te Chung; Ude Lu

(57) ABSTRACT

Gate Driver on Array (GOA) circuit and display device solving problem of electrical stress easily biasing threshold voltage of thin film transistor (TFT), are provided. The GOA circuit including m cascaded GOA units, wherein an $n^{th}$ GOA unit includes a pull-up control unit, a pull-up unit, a compensation control unit, and a pull-down unit.

8 Claims, 5 Drawing Sheets

(58) Field of Classification Search
CPC .. G09G 3/3681; G09G 3/3685; G09G 3/3688; G09G 3/3692; G09G 2300/0408
USPC ..... 345/87–104
See application file for complete search history.

(56) References Cited

U.S. PATENT DOCUMENTS

2014/0085285 A1* 3/2014 Kim ..... G09G 5/003 377/67
2014/0240209 A1* 8/2014 Zhang ..... G09G 3/3677 377/64
2015/0102735 A1* 4/2015 Kuo ..... H03K 17/6871 315/161
2015/0185520 A1* 7/2015 Xu ..... G09G 3/3655 327/108
2015/0206495 A1* 7/2015 Xu ..... G09G 3/3677 345/94
2015/0207503 A1 7/2015 Xu et al.
2015/0356934 A1* 12/2015 Yamashita ..... G09G 3/3611 345/99
2016/0086562 A1* 3/2016 Tan ..... G11C 19/184 345/215
2016/0335962 A1* 11/2016 Xiao ..... G09G 3/3677
2017/0132984 A1* 5/2017 Dai ..... G09G 3/3677
2017/0200419 A1* 7/2017 Ma ..... G11C 19/28
2018/0211606 A1 7/2018 Zhang et al.
2018/0226008 A1* 8/2018 Zhou ..... G09G 3/20
2018/0293924 A1* 10/2018 Wang ..... G09G 3/20
2018/0336831 A1* 11/2018 Shi ..... H01L 33/00
2019/0088190 A1 3/2019 Zhang et al.
2019/0156759 A1 5/2019 Wang
2019/0214104 A1* 7/2019 Qian ..... G11C 19/28
2019/0340987 A1 11/2019 Huang et al.
2021/0193006 A1* 6/2021 Wang ..... G09G 3/20

FOREIGN PATENT DOCUMENTS

CN 104269152 A 1/2015
CN 104464671 A 3/2015
CN 105810170 A 7/2016
CN 106297704 A 1/2017
CN 107516491 A 12/2017
CN 107833557 A 3/2018
CN 108573667 A 9/2018
CN 109448630 A 3/2019
CN 109637484 A 4/2019
CN 116148382 A 6/2019
CN 109979398 A 7/2019
CN 110136652 A 8/2019
CN 110415664 A 11/2019
CN 110534052 A 12/2019
KR 20140064319 A 5/2014

* cited by examiner

| GOA signal | Voltage setting | |
|---|---|---|
| | Min.(V) | Max.(V) |
| Cout(n-1) | -10 | +20 |
| Cout(n+1) | -10 | +20 |
| Cout(n+2) | -10 | +20 |
| CK1 | -10 | +20 |
| CK2 | -10 | +20 |
| VGL | -10 | |

GATE DRIVER ON ARRAY (GOA) CIRCUIT AND DISPLAY DEVICE SOLVING PROBLEM OF ELECTRICAL STRESS EASILY BIASING THRESHOLD VOLTAGE OF THIN FILM TRANSISTOR (TFT)

CROSS REFERENCE TO RELATED APPLICATION

This application claims the priority of International Application No. PCT/CN2020/090122, filed on May 14, 2020 which claims priority to Chinese Application No. 202010146510.5 filed on Mar. 5, 2020. The entire disclosures of each of the above applications are incorporated herein by reference.

BACKGROUND OF INVENTION

Field of Invention

The present invention relates to the field of electronic display, and in particular, to a gate driver on array (GOA) circuit, TFT substrate, display device, and electronic equipment.

Description of Prior Art

The current world has entered an "information revolution" era, where display technology and display devices have occupied a very important position in the development of information technology. Display screens of portable devices and various instruments, such as televisions, computers, mobile phones, personal digital assistants (PDAs) provide a lot of information for people's daily life and work. Without display devices, there would not be the rapid development of information technology today.

With the continuous development of electronic devices toward high integration, low power consumption, and portability, people's requirements for displays have become higher and higher, which is mainly reflected in the following aspects: high resolution, narrow bezels, flexible displays, and so on. Display resolution has evolved from the traditional 720p or 1080p to the current 4K or even 8K.

As a new generation display device, organic light emitting diode (OLED) displays have been widely used because of their simple structure, ultra-thin, self-luminous, high brightness, fast response time, wide viewing angles, high efficiency, low operating voltage, low cost, etc.

In active liquid crystal displays, which are active matrix organic light emitting diode panels (AMOLED), each pixel has a thin film transistor (TFT), a gate of the TFT connected to a horizontal scanning line, a drain of the TFT connected to a vertical data line, and a source of the TFT connected to a pixel electrode. Applying enough voltage on the horizontal scanning line will turn on all TFTs on that line. At this time, the pixel electrode on the horizontal scanning line is connected to the data line in the vertical direction, so that the display signal voltage on the data line is written into the pixel, and the transmittance of different liquid crystals is controlled to achieve the effect of controlling color.

Please refer to FIG. 1, at present, the driving of the horizontal scanning lines of the active liquid crystal display panel is mainly driven by an external integrated circuit (IC). The external IC can control the progressive charging and discharging of the horizontal scanning lines at all levels. However, the gate line is connected to the IC, and border lines are very dense, occupying a large space.

Aiming at the problems of dense border lines and large space occupied by the external IC driving horizontal scanning lines, at present, gate driver on array (GOA) technology has been applied to liquid crystal displays. Please refer to FIG. 2, which can use the original manufacturing process of the liquid crystal display panel to make the driving circuit of the horizontal scanning line on the substrate around the display area, so that it can replace the external IC to complete the driving of the horizontal scanning line. GOA devices replace dense gate lines, reduce the binding process of external ICs, simplify the production process, reduce costs, and narrow the frame of liquid crystal display devices. Furthermore, the volume and weight of the liquid crystal display are made thinner and thinner, which is more suitable for making narrow-frame or borderless display products.

Indium gallium zinc oxide (IGZO) has high mobility and good device stability, and is currently widely used in IGZO-GOA circuits. The pixel circuit of an AMOLED panel uses a thin film transistor to form a current source to light up the panel. Please refer to FIG. 3, a drain of a driving TFT (T2) of GOA is connected to a CK clock signal. When the TFT (T2) is electrically stressed by Vgs and Vds, a threshold voltage of the TFT (T2) is easily forward biased, resulting in a decrease in the output capacity of the GOA.

Therefore, how to prevent TFTs in the GOA circuit from being subjected to the electrical stress of Vgs and Vds, which causes the threshold voltage of the TFT to be easily biased, and leads to a decrease in the output capacity of the GOA has become a technical problem to be solved urgently by those skilled in the art and always the focus of research.

Technical Problems

How to prevent TFTs in the GOA circuit from being subjected to the electrical stress of Vgs and Vds, which causes the threshold voltage of the TFT to be easily biased, and leads to a decrease in the output capacity of the GOA has become a technical problem without effective solution.

SUMMARY OF INVENTION

In view of this, embodiments of the present invention provide a gate driver on array (GOA) circuit, a TFT substrate, a display device, and an electronic equipment to solve the problems that TFTs in the GOA circuit are subjected to the electrical stress of Vgs and Vds, which causes the threshold voltage of the TFT to be easily biased, and leads to a decrease in the output capacity of the GOA.

To this end, the embodiments of the present invention provide the following technical solutions:

According to a first aspect of the present invention, a GOA circuit comprising m cascaded GOA units, wherein an $n^{th}$ GOA unit comprises: a pull-up control unit, a pull-up unit, a compensation control unit, and a pull-down unit; wherein the pull-up control unit is connected to the compensation control unit and the pull-up unit respectively, the compensation control unit is connected to the pull-up control unit, the pull-up unit and the pull-down unit respectively, the pull-up unit is connected to the pull-up control unit, the compensation control unit, and the pull-down unit respectively, and the pull-down unit is connected to the pull-up unit and the compensation control unit respectively; wherein

- the pull-up control unit is connected to an $n+1^{th}$ stage row scanning signal Cout (n−1), and is configured to raise a potential at a Q point;
- the pull-up unit is configured to output an $n^{th}$ stage row scanning signal Cout (n) of a high potential;

the compensation control unit is configured to control a threshold voltage of a thin film transistor in the pull-up unit to be stored in a capacitor in the pull-up unit;

the pull-down unit is configured to pull the potential of the $n^{th}$ stage row scanning signal Cout (n) to a low potential;

wherein m and n are positive integers and m≥n≥1.

With reference to the first aspect of the present invention, in a first embodiment of the first aspect of the present invention, wherein the compensation control unit comprises a fourth thin film transistor, a gate of the fourth thin film transistor is connected to the $n+1^{th}$ stage row scanning signal Cout (n+1), a drain of the fourth thin film transistor is connected to a source of a first thin film transistor in the pull-up control unit and a gate of a second thin film transistor in the pull-up unit, a source of the fourth thin film transistor is connected to a drain of the third thin film transistor in the pull-down unit, a source of the second thin film transistor in the pull-up unit, and the $n^{th}$ stage row scanning signal Cout (n).

With reference to the first aspect of the present invention, in a second embodiment of the first aspect of the present invention, wherein the pull-up control unit comprises the first thin film transistor, a drain and a gate of the first thin film transistor are connected to an $n-1^{th}$ stage row scanning signal Cout (n−1) respectively, the source of the first thin film transistor is connected to a drain of the fourth thin film transistor and the pull-up unit.

With reference to the first aspect of the present invention, in a third embodiment of the first aspect of the present invention, wherein the pull-up unit comprises the second thin film transistor and a first capacitor, a drain of the second thin film transistor is connected to a clock signal CK, a gate of the second thin film transistor is connected to a source of the first thin film transistor and a drain of the fourth thin film transistor, the source of the first thin film transistor is connected to the $n^{th}$ stage row scanning signal Cout (n) through the first capacitor, the source of the second thin film transistor is connected to the $n^{th}$ stage row scanning signal Cout (n) and the pull-down unit.

With reference to the first aspect of the present invention, in a fourth embodiment of the first aspect of the present invention, wherein the pull-down unit comprises a third thin film transistor, the drain of the third thin film transistor is connected to the source of the second thin film transistor, the $n^{th}$ stage row scanning signal Cout (n), and the source of the fourth thin film transistor, a gate of the third thin film transistor is connected to the $n+2^{th}$ stage row scanning signal Cout (n+2), and a source of the third thin film transistor is connected to VGL.

With reference to the first aspect of the present invention, in a fifth embodiment of the first aspect of the present invention, wherein the source of the first thin film transistor and the drain of the fourth thin film transistor are connected through a second capacitor.

With reference to the first aspect of the present invention, in a sixth embodiment of the first aspect of the present invention, wherein the thin film transistor is an indium gallium zinc oxide (IGZO) thin film transistor.

According to a second aspect of the present invention, a thin film transistor (TFT) substrate is provided, which includes the GOA circuit according to any one of the embodiments of the first aspect.

According to a third aspect of the present invention, a display device is provided, which includes the TFT substrate described in the embodiment of the second aspect of the present invention.

According to a fourth aspect of the present invention, an electronic equipment is provided, which includes the display device described in the embodiment of the third aspect of the present invention.

Beneficial Effects

An embodiment of the present invention provides a GOA circuit, a TFT substrate, a display device, and an electronic equipment, the GOA circuit comprises m cascaded GOA units, wherein an $n^{th}$ GOA unit comprises: a pull-up control unit, a pull-up unit, a compensation control unit, and a pull-down unit; wherein the pull-up control unit is connected to the compensation control unit and the pull-up unit respectively, the compensation control unit is connected to the pull-up control unit, the pull-up unit and the pull-down unit respectively, the pull-up unit is connected to the pull-up control unit, the compensation control unit, and the pull-down unit respectively, and the pull-down unit is connected to the pull-up unit and the compensation control unit respectively; wherein the pull-up control unit is connected to an $n-1^{th}$ stage row scanning signal Cout (n−1), and is configured to raise a potential at a Q point; the pull-up unit is configured to output an $n^{th}$ stage row scanning signal Cout (n) of a high potential; the compensation control unit is configured to control a threshold voltage of a thin film transistor in the pull-up unit to be stored in a capacitor in the pull-up unit; the pull-down unit is configured to pull the potential of the $n^{th}$ stage row scanning signal Cout (n) to a low potential; wherein m and n are positive integers and m≥n≥1. The problems that TFTs in the GOA circuit are subjected to the electrical stress of Vgs and Vds, which causes the threshold voltage of the TFT to be easily biased, and leads to a decrease in the output capacity of the GOA are solved, the correct output of the signal is ensured.

BRIEF DESCRIPTION OF DRAWINGS

In order to describe clearly the embodiment in the present disclosure or the prior art, the following will introduce the drawings for the embodiment shortly. Obviously, the following description is only a few embodiments, for the common technical personnel in the field it is easy to acquire some other drawings without creative work.

DETAILED DESCRIPTION OF PREFERRED EMBODIMENTS

Figure 1:
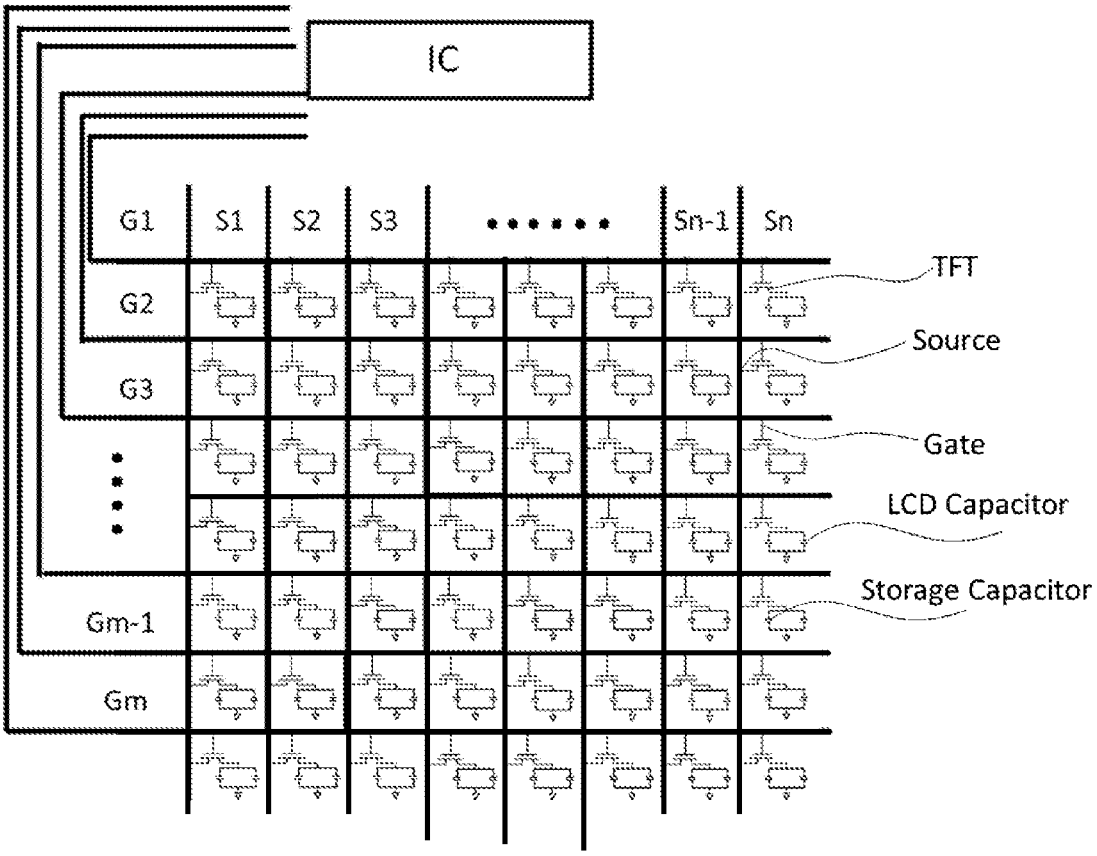
Prior Art FIG. 1
FIG. 1 is a schematic diagram of a horizontal scanning line of a liquid crystal display panel driven by an external integrated circuit.
Figure 2:
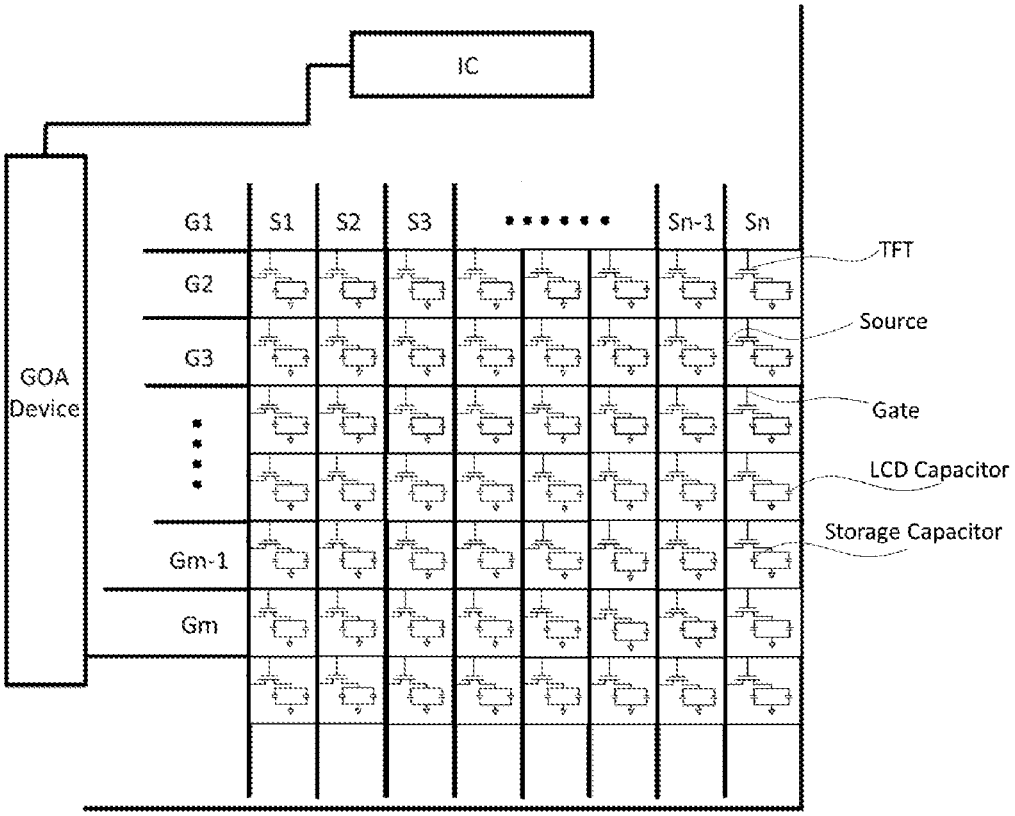
Prior Art FIG. 2
FIG. 2 is a schematic diagram of horizontal scanning lines of a liquid crystal display panel driven by gate driver on array (GOA).
Figure 3:
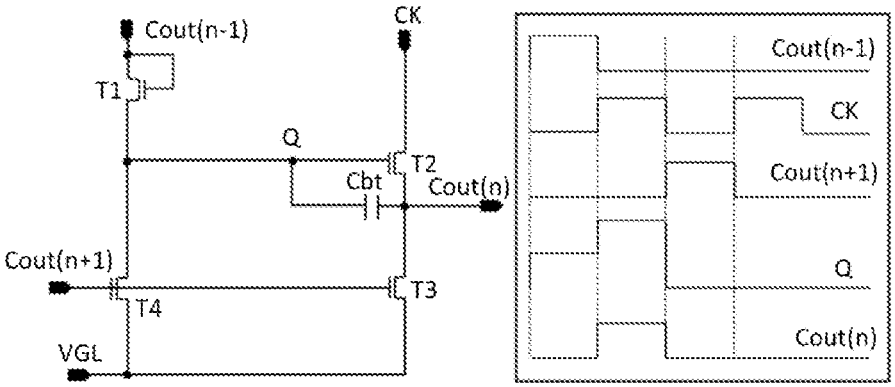
Prior Art FIG. 3
FIG. 3 is a GOA circuit and timing diagram according to the prior art.

The technical solution of a gate driver on array (GOA) circuit, a TFT substrate, a display device, and an electronic equipment provided by the present invention is clearly and completely described below with reference to the accompanying drawings. Obviously, the described embodiments are only a part of the embodiments of the present invention, but not all the embodiments. Based on the embodiments of the present invention, all other embodiments obtained by those skilled in the art without creative work fall into the protection scope of the present invention.

In the description of the present invention, it is understood that the orientation or position relationship indicated by the terms such as "center", "portrait", "landscape", "length", "width", "thickness", "up", "low", "front", "rear", "left", "right", "vertical", "horizontal", "top", "bottom", "inside", "outside", etc. are based on the orientation or position relationship shown in the drawings, it is only for the convenience of describing the present invention and simplifying the description, rather than indicating or implying that the device or element referred to must have a specific orientation, construction and operation in a specific orientation. Therefore, it cannot be understood as a limitation to the present invention. In addition, the terms "first", "second", "third", etc. are used for descriptive purposes only, and should not be interpreted as indicating or implying relative importance or implicitly indicating the number of technical features indicated. Therefore, the features defined as "first", "second", and "third" may explicitly or implicitly include one or more features. In the description of the present invention, the meaning of "plurality" is two or more, unless specifically defined otherwise.

In the present invention, the terms "installation", "connected", "connection", "fixed" and the like shall be understood in a broad sense unless otherwise specified and defined, For example, they can be a fixed connection, a detachable connection, or an integral unit; they can be mechanical or electrical connection; they can be directly connected or indirectly connected through an intermediate medium, they can be the internal connection of the two elements or the interaction relationship between the two elements, unless explicitly defined otherwise. For those of ordinary skill in the art, the specific meanings of the above terms in the present invention can be understood according to specific situations.

In the present invention, the term "exemplary" is used to mean "serving as an example, illustration, or illustration." Any embodiment described herein as "exemplary" is not necessarily to be construed as preferred or advantageous over other embodiments. In order to enable any person skilled in the art to implement and use the present invention, the following description is given. In the following description, the invention is set forth in detail for the purpose of explanation. It should be understood by those of ordinary skill in the art that the present invention can be implemented even without using these specific details. In other instances, well-known structures and procedures will not be described in detail in order to avoid unnecessary details from obscuring the description of the present invention. Therefore, the present invention is not intended to be limited to the illustrated embodiments, but should be consistent with the widest scope consistent with the principles and features disclosed by the present invention.

In the prior art, a forward bias stress of IGZO-TFT is not ideal, long-term forward bias stress will cause a threshold voltage (Vth) of the TFT to drift forward. An opening speed of the IGZO-TFT device becomes slower, which in turn has a serious impact on the gate drive circuit. The embodiments of the present invention provide a GOA circuit which can be used for LCD displays or OLED displays. The GOA circuit can be included in products or components with display functions, such as LCD TVs, mobile phones, digital cameras, tablet computers, computers, electronic paper, navigators, and the like.

It should be noted that the technical features involved in different embodiments of the present invention described below can be combined as long as they do not conflict with each other.

Figure 4:
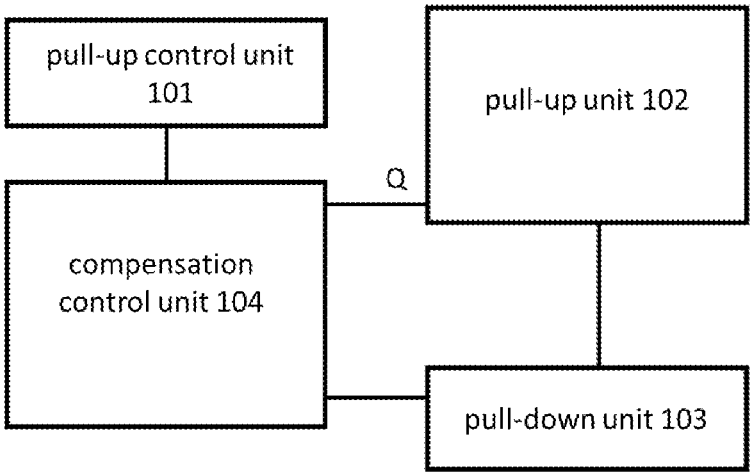
FIG. 4 is a schematic diagram of a GOA unit according to an embodiment of the present invention.

The pixel circuit of the AMOLED panel uses thin-film transistors to form a current source to light the panel. When IGZO-TFT is subjected to stress, Vth is likely to shift, so the pixel circuit needs to use a compensation circuit to compensate for Vth. FIG. 4 is a schematic diagram of a GOA unit according to an embodiment of the present invention, please refer to FIG. 4, a GOA circuit is provided, the GOA circuit includes m cascaded GOA units, and an $n^{th}$ GOA unit includes: a pull-up control unit 101, a pull-up unit 102, a compensation control unit 104, and a pull-down unit 103, wherein m and n are positive integers, and $m \geq n \geq 1$.

The pull-up control unit 101 is connected to the compensation control unit 104 and the pull-up unit 102, the compensation control unit 104 is connected to the pull-up control unit 101, the pull-up unit 102, and the pull-down unit 103. The pull-up unit 102 is connected to the pull-up control unit 101, the compensation control unit 104, and the pull-down unit 103. The pull-down unit 103 is connected to the pull-up unit 102 and the compensation control unit 104. The pull-up control unit 101 is an effective method to reduce the leakage current at Q point. The pull-up control unit 101 can reduce the leakage current at point Q to a certain extent. The ability to maintain the potential at point Q is the key to ensuring the stable output of the GOA circuit.

The pull-up control unit 101 is connected to an $n-1^{th}$ stage row scanning signal Cout (n−1) to raise the potential of Q point, and the pull-up unit 102 is used to output the $n^{th}$ stage row scanning signal Cout (n) of a high potential. The compensation control unit 104 is used to cause a thin film transistor in the pull-up control unit 102 to form a diode connection structure. Threshold voltage of thin film transistors in the control pull-up unit 102 is stored in the capacitor in the pull-up unit 102. The pull-down unit 103 is used to pull down the potential of the $n^{th}$ stage row scanning signal Cout (n) to a low potential.

In a specific optional embodiment, the capacitor is a bootstrap capacitor. The bootstrap capacitor uses the characteristic that the voltage across the capacitor cannot be abrupt. When a certain voltage is maintained across the capacitor, increase the negative voltage of the capacitor, the positive voltage still maintains the original voltage difference with the negative terminal, and the voltage equal to the positive terminal is lifted by the negative terminal. In an alternative embodiment, one end of the bootstrap capacitor is electrically connected to one end of the pull-up control unit 101 outputting the pull-up control signal Q (N), the other end of the bootstrap capacitor is electrically connected to one end of the $n^{th}$ stage row scanning signal G (n) of the current row array circuit row drive circuit unit output by the pull-up unit 102. The bootstrap capacitor is mainly used to raise potential, and is used to generate a high level scan signal of the current stage. The voltage between a gate and a source of the thin film transistor in the pull-up unit 102 is maintained to stabilize the output of the thin film transistor, that is, the output of the $n^{th}$ stage row scanning signal G (n).

Figure 5:
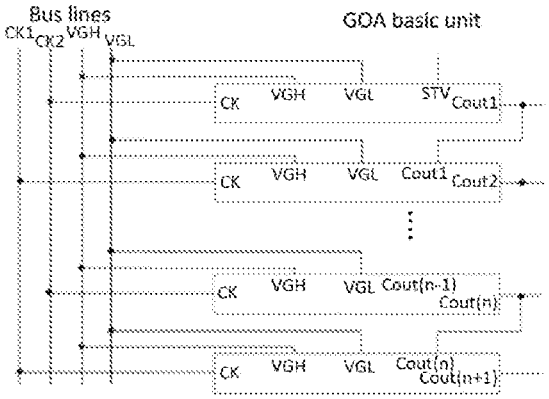
FIG. 5 is a GOA unit level transmission relationship and a signal timing according to an embodiment of the present invention.

The GOA circuit includes m cascaded GOA units, please refer to FIG. 5, FIG. 5 is a GOA cell level transmission relationship and signal timing according to an embodiment of the present invention. The GOA circuit contains m cascaded GOA units, each level of GOA unit correspondingly drives a raw scanning line. The structure of all single-stage GOA units is almost the same, and there are only slight differences in the first and last stages. These differences are not related to this application, so they will not be described in detail here. When the $n^{th}$ stage GOA unit is driven, the $n^{th}$ stage GOA unit outputs a high-level $n^{th}$ row scan signal G (n) and an $n^{th}$ stage transfer signal ST (n). Among them, the $n^{th}$ row scanning signal G (n) is used to turn on a TFT switch of each pixel in a row in the panel and charge a pixel electrode in each pixel. The $n^{th}$ stage transmission signal ST (n) is used to provide a stage transmission signal for a next level during forward scanning, and is used to provide a stage transmission signal for a last level during backward scanning.

The GOA circuit provided in this embodiment is consistent with the working principle of the above-mentioned GOA unit embodiment. For the specific structural relationship and working principle, refer to the above-mentioned GOA unit embodiment, which will not be repeated here.

Figure 6:
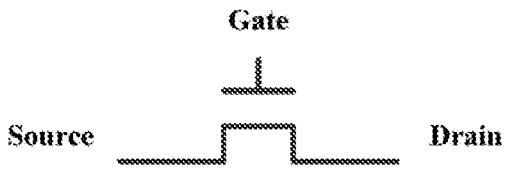
FIG. 6 is an equivalent circuit diagram of a thin film transistor.

The GOA circuit according to embodiments of the present invention may include a plurality of thin film transistors. FIG. 6 is an equivalent circuit diagram of a thin film transistor. Three electrodes of the thin film transistor are called a gate, a source, and a drain. Correspondingly, voltages loaded on the respective electrodes can be marked as Vg, Vs and Vd, respectively. Here, the source and the drain are actually indistinguishable, but for convenience of description, in the exemplary embodiment, the lower end is generally called the source, and the higher end is called the drain. Therefore, voltage Vgs=Vg−Vs that determines the state of the thin film transistor. When Vgs>0, the thin film transistor is turned on, and the current flows from the drain to the source. When Vgs=0, the thin film transistor is in a micro-conduction state, and current flows from the drain to the source. When Vgs<0, the device is off. Alternatively, in other exemplary embodiments, the lower voltage end may be referred to as the drain, and the higher voltage end may be referred to as the source, that is, when the thin film transistor is in the on state, current flows from the source to the drain.

The Q point in the GOA circuit is the gate point of the thin film transistor that controls the high level of the output signal. When the Q point is at a high potential, the thin film transistor is turned on, and the output signal remains at a high potential. Voltage VGL+Vth of the above-mentioned GOA circuit will always be stored at the Q point, thereby solving the problem that the GOA circuit buffer TFT in the prior art is subjected to the stress of the CK signal Vds, and the Vth of the TFT is prone to positive deviation, resulting in serious distortion of the output signal. To a large extent, the stability of the gate drive circuit is improved, which is beneficial to the improvement of the display effect of the liquid crystal display panel.

In an alternative embodiment, the GOA unit may be manufactured based on IGZO-TFT.

Figure 7:
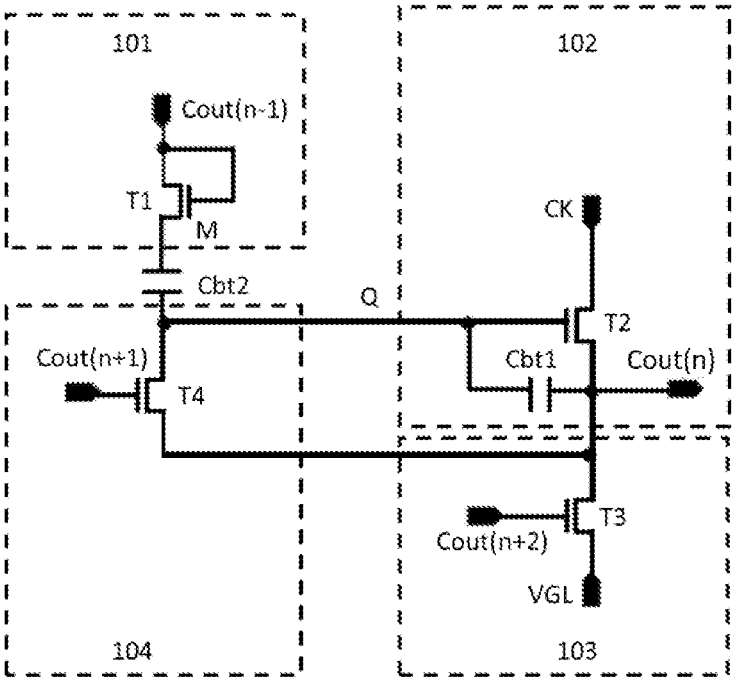
FIG. 7 is a circuit diagram of a GOA unit according to an embodiment of the present invention.

FIG. 7 is a circuit diagram of a GOA unit according to an embodiment of the present invention. Referring to FIG. 7, the pull-up control unit 101 includes a first thin film transistor T1, a drain and a gate of the first thin film transistor T1 are connected to the $n-1^{th}$ stage row scanning signal Cout (n−1), a source of the first thin film transistor T1 is connected to the compensation control unit 104 and the pull-up unit 102. Specifically, the source of the first thin film transistor T1 is connected to a drain of the fourth thin film transistor T4 in the compensation control unit 104, the source of the first thin film transistor T1 is connected to a gate of the second thin film transistor T2 in the pull-up unit 102.

The pull-up unit 102 includes a second thin film transistor T2 and a first capacitor Cbt1, the drain of the second thin film transistor T2 is connected to the clock signal CK, the gate of the second thin film transistor T2 is connected to the source of the first thin film transistor T1, the source of the first thin film transistor T1 is connected to the $n^{th}$ stage row scanning signal Cout (n) through the first capacitor Cbt1, a source of the second thin film transistor T2 is connected to the $n^{th}$ stage row scanning signal Cout (n) and the pull-down unit 103, respectively. Specifically, the source of the second thin film transistor T2 is connected to a drain of the third thin film transistor T3 in the pull-down unit 103.

The pull-down unit 103 includes a third thin film transistor T3, the drain of the third thin film transistor T3 is connected to the source of the second thin film transistor T2, the $n^{th}$ stage row scanning signal Cout (n) and the compensation control unit 104. Specifically, the drain of the third thin-film transistor T3 is connected to a source of the fourth thin-film transistor T4 in the compensation control unit 104, and the gate of the third thin-film transistor T3 is connected to the $n+2^{th}$ stage row scanning signal Cout (n+2). A source of the third thin film transistor T3 is connected to VGL.

The compensation control unit 104 includes a fourth thin film transistor T4, a gate of the fourth thin film transistor T4 is connected to the $n+1^{th}$ stage row scanning signal Cout (n+1), a drain of the fourth thin film transistor T4 is connected to the source of the first thin film transistor T1, and a source of the fourth thin film transistor T4 is connected to the drain of the third thin film transistor T3 and the $n^{th}$ stage row scanning signal Cout (n).

In an alternative embodiment, the source of the first thin film transistor and the drain of the fourth thin film transistor are connected by a second capacitor. Please refer to FIG. 8, in S1 stage, the potential of Q point is VGL+Vth. In the S2 stage, the $n-1^{th}$ stage row scanning signal Cout (n−1) becomes high potential. According to the principle of capacitive coupling, the high potential of VGH is written to point Q, the potential at point Q will be VGL+Vth+VGH.

Figure 8:
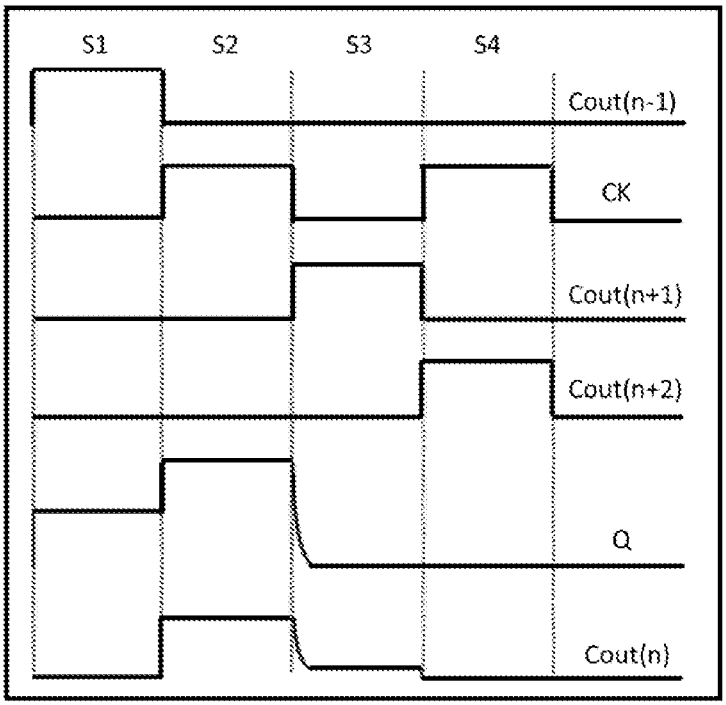
FIG. 8 is a schematic diagram of a signal source required by a GOA unit according to an embodiment of the present invention.

FIG. 8 is a schematic diagram of a signal source required by a GOA unit according to an embodiment of the present invention. The working principle of the GOA unit according to an embodiment of the present invention is described below in conjunction with FIG. 8.

S1 stage: the potential at the point Q is VGL+Vth, and then the $n-1^{th}$ stage row scanning signal Cout (n−1) rises to a high potential, the potential at point M rises from VGL to VGH, and point Q is theoretically coupled to (VGH−VGL)·Cbt2/(Cbt1+Cbt2)+VGL+Vth, the second thin film transistor T2 is turned on, and the $n^{th}$ stage row scanning signal Cout (n) remains low.

S2 stage: the $n-1^{th}$ stage row scanning signal Cout (n−1) drops to low potential, the first thin film transistor T1 is turned off, and the second thin film transistor T2 remains on. The Cout (n) potential rises from VGL to VGH, and the point Q potential is theoretically (VGH−VGL)Cbt1/(Cbt1+Cbt2)+(VGH−VGL) Cbt2/(Cbt1+Cbt2)+VGL+Vth=VGH+Vth, the potential of the second thin film transistor T2 is Vgs-Vth=VGH. Therefore, the current of the second thin film transistor T2 is independent of Vth, and the output waveform of the GOA is not affected by the Vth shift of the second thin film transistor T2.

S3 stage: the $n+1^{th}$ stage row scanning signal Cout (n+1) rises to a high potential, the fourth thin film transistor T4 turns on, the clock signal CK drops from a high potential to a low potential, and the gate and drain of the second thin film transistor T2 are connected to each other to form a diode structure. The second thin film transistor T2 will generate a current discharge, the voltage of the gate and the drain will decrease at the same time, when it drops to VGL+Vth, the gate voltage (VGL+Vth) minus the source voltage (VGL) is exactly equal to Vth. Therefore, the second thin film transistor T2 will be turned off and the gate voltage will not continue to decrease. Due to the existence of the storage capacitor Cbt1, the voltage of VGL+Vth will always be stored at the Q point.

Stage S4: the n+2$^{th}$ stage row scanning signal Cout (n+2) rises to a high potential, the third thin film transistor T3 is turned on, and the n$^{th}$ stage row scanning signal Cout (n) potential is reset to VGL.

In an optional embodiment, the transistor used in the embodiment of the present invention may be a thin film transistor, a field effect transistor, or other devices with the same characteristics. For example, the thin film transistor is an IGZO thin film transistor. According to the function in the circuit, the transistor used in the embodiment of the present invention is mainly a switching transistor. Since the source and drain of the switching transistor used here are symmetrical, the source and drain are interchangeable, and the source is preferably connected to the power supply. The middle terminal of the transistor is the gate, the signal input terminal is the source, and the signal output terminal is the drain. Switching transistors include P-type switching transistors and N-type switching transistors. In the embodiment of the present invention, all the thin film transistors described in the GOA unit are metal oxide semiconductor thin film transistors, polycrystalline silicon thin film transistors, or amorphous silicon thin film transistors, and are all N-type thin film transistors.

Another embodiment of the present invention further provides a TFT substrate, including the GOA circuit described in the above embodiment.

Another embodiment of the present invention further provides a display device, including the TFT substrate described in the above embodiment.

Another embodiment of the present invention also provides an electronic device, including the display device described in the above embodiment. For example, the electronic device may be a product with a display function such as an LCD TV, a mobile phone, a digital camera, a tablet computer, a computer, an electronic paper, and a navigator.

In summary, the GOA circuit structure of the present invention solves the problem that the GOA circuit buffer TFT in the prior art is subjected to the stress of the CK signal Vds, and the Vth of the TFT is prone to positive deviation, resulting in serious distortion of the output signal. To a large extent, the stability of the gate drive circuit is improved, which is beneficial to the improvement of the display effect of the liquid crystal display panel.

Although the present disclosure has been shown and described with respect to one or more implementations, those skilled in the art will think of equivalent variations and modifications based on reading and understanding of this specification and the drawings. This disclosure includes all such modifications and variations, and is limited only by the scope of the appended claims. In particular with regard to the various functions performed by the above-mentioned components, the terminology used to describe such components is intended to correspond to any component (unless otherwise indicated) that performs the specified function of the component (eg it is functionally equivalent), even if it is structurally different from the disclosed structure that performs the functions in the exemplary implementation of the present specification shown herein.

Furthermore, although specific features of this specification have been disclosed with respect to only one of several implementations, such features can be combined with one or more other features of other implementations as may be desired and advantageous for a given or specific application. Moreover, to the extent that the terms "including", "having", "containing" or variations thereof are used in specific embodiments or claims, such terms are intended to be included in a manner similar to the term "comprising".

The above are only the preferred embodiments of the present disclosure. It should be pointed out that those of ordinary skill in the art can make several improvements and retouching without departing from the principles of the present disclosure. protected range.

INDUSTRIAL APPLICABILITY

The voltage of the GOA circuit VGL+Vth in the embodiment of the present invention is always stored at the Q point, the GOA circuit structure of the present invention solves the problem that the GOA circuit buffer TFT in the prior art is subjected to the stress of the CK signal Vds, and the Vth of the TFT is prone to positive deviation, resulting in serious distortion of the output signal. To a large extent, the stability of the gate drive circuit is improved, which is beneficial to the improvement of the display effect of the liquid crystal display panel.

What is claimed is:

1. A Gate Driver On Array (GOA) circuit comprising m cascaded GOA units, wherein an n$^{th}$ GOA unit comprises: a pull-up control circuit, a pull-up circuit, a compensation control circuit, and a pull-down circuit; wherein m and n are positive integers and m≥n≥1; wherein the pull-up control circuit is connected to the compensation control circuit and the pull-up circuit respectively, the compensation control circuit is connected to the pull-up control circuit, the pull-up circuit, and the pull-down circuit respectively, the pull-up circuit is connected to the pull-up control circuit, the compensation control circuit, and the pull-down circuit respectively, and the pull-down circuit is connected to the pull-up circuit and the compensation control circuit respectively; wherein the pull-up control circuit comprises a first thin film transistor, the pull-up circuit comprises a second thin film transistor and a first capacitor, the pull-down circuit comprises a third thin film transistor, and the compensation control circuit comprises a fourth thin film transistor;

a gate of the fourth transistor is connected to an n+1$^{th}$ stage row scanning signal Cout (n+1), a drain of the fourth thin film transistor is connected to a source of the first thin film transistor in the pull-up control circuit and a gate of the second thin film transistor in the pull-up circuit, a source of the fourth thin film transistor is connected to a drain of the third thin film transistor in the pull-down circuit, a source of the second thin film transistor in the pull-up circuit, and an n$^{th}$ stage row scanning signal Cout (n), and wherein the compensation control circuit is configured to control a threshold voltage of the second thin film transistor in the pull-up circuit to be stored in the first capacitor in the pull-up circuit;

the pull-up control circuit is connected to an n−1$^{th}$ stage row scanning signal Cout (n−1), and is configured to raise a potential at a Q point;

the pull-up circuit is configured to output the n$^{th}$ stage row scanning signal Cout (n) of a high potential; and the pull-down circuit is configured to pull the high potential of the $n^{th}$ stage row scanning signal Cout (n) to a low potential.

2. The GOA circuit according to claim 1, wherein a drain and a gate of the first thin film transistor are connected to the $n-1^{th}$ stage row scanning signal Cout (n−1) respectively, the source of the first thin film transistor is connected to the drain of the fourth thin film transistor and the pull-up circuit.

3. The GOA circuit according to claim 2, wherein a drain of the second thin film transistor is connected to a clock signal CK, the gate of the second thin film transistor is connected to the source of the first thin film transistor and the drain of the fourth thin film transistor, the source of the first thin film transistor is connected to the $n^{th}$ stage row scanning signal Cout (n) through the first capacitor, the source of the second thin film transistor is connected to the $n^{th}$ stage row scanning signal Cout (n) and the pull-down-circuit.

4. The GOA circuit according to claim 3, wherein the drain of the third thin film transistor is connected to the source of the second thin film transistor, the $n^{th}$ stage row scanning signal Cout (n), and the source of the fourth thin film transistor, a gate of the third thin film transistor is connected to an $n+2^{th}$ stage row scanning signal Cout (n+2), and a source of the third thin film transistor is connected to a ground.

5. The GOA circuit according to claim 4, wherein the source of the first thin film transistor and the drain of the fourth thin film transistor are connected through a second capacitor.

6. The GOA circuit according to claim 1, wherein the first thin film transistor, the second thin film transistor, the third thin film transistor, and the fourth thin film transistor are of an indium gallium zinc oxide (IGZO) thin film transistor.

7. A thin film transistor (TFT) substrate comprising the GOA circuit according to claim 1.

8. A display device comprising the TFT substrate according to claim 7.

* * * * *